United States Patent [19]

Leung et al.

[11] Patent Number: 4,622,269

[45] Date of Patent: Nov. 11, 1986

[54] ELECTRICAL CONTACT AND PROCESS FOR MAKING THE SAME

[75] Inventors: Chi H. Leung; Ron J. DeNuccio, both of Greensboro, N.C.

[73] Assignee: GTE Products Corporation, Stamford, Conn.

[21] Appl. No.: 814,439

[22] Filed: Dec. 30, 1985

[51] Int. Cl.[4] ..... B22F 3/10

[52] U.S. Cl. ..... 428/550; 200/265; 200/268; 252/503; 252/504; 252/512; 252/514; 252/516; 252/518; 419/18; 419/19; 419/21; 419/23; 419/28; 419/57; 419/58; 428/552; 428/565; 428/929

[58] Field of Search ..... 419/18, 19, 21, 23, 419/28, 57, 58; 428/552, 565, 929, 550; 252/503, 504, 512, 514, 516, 518; 200/265, 268

[56] References Cited

U.S. PATENT DOCUMENTS

| | | | |
|---|---|---|---|
| 3,385,677 | 5/1968 | Schreiner et al. | 419/21 |
| 3,969,112 | 7/1976 | Kim et al. | 419/21 |
| 4,088,480 | 5/1978 | Kim et al. | 419/27 |
| 4,092,157 | 5/1978 | Reid et al. | 419/21 |
| 4,137,076 | 1/1979 | Hoyer et al. | 75/241 |
| 4,217,139 | 8/1980 | Kim et al. | 419/21 |

*Primary Examiner*—Stephen J. Lechert, Jr.
*Attorney, Agent, or Firm*—James Theodosopoulos

[57] ABSTRACT

An electrical contact formed of a mixture of finely divided electrically conductive metal doped with graphite or cadmium oxide. A thin coating of the electrically conductive metal is disposed upon the side of the contact which is adapted to be welded or brazed to an electrically conductive support. The electrical contact is made by mixing the finely divided cadmium oxide and pressing the mixture into a desired shape. A slurry of conductive metal is then sprayed on one side of the contact. After coating, the contact is sintered at a temperature less than the melting point of the electrically conductive material, whereby the contact is formed and the coating is firmly attached to it. The invention is particularly useful with silver or copper-based electrical contacts.

16 Claims, 1 Drawing Figure

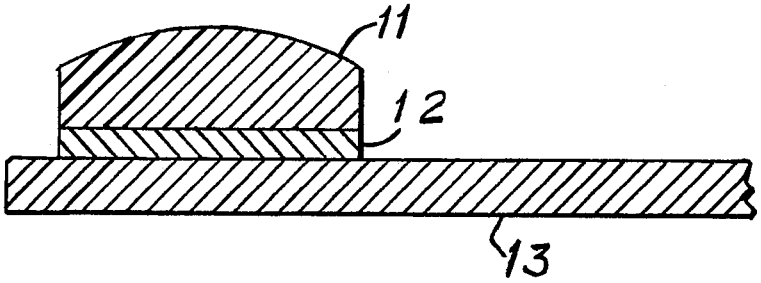
11
12
13

ELECTRICAL CONTACT AND PROCESS FOR MAKING THE SAME

FIELD OF THE INVENTION

The present invention relates to non-sticking electrical contacts that are to be welded or brazed to a support structure. Such electrical contacts are frequently formed of silver or copper and are doped with graphite or cadmium oxide to reduce the contact resistance and inhibit arc welding. The contact may be further doped with materials such as tungsten carbide to provide additional enhancement of its resistance to arc welding or sticking.

DESCRIPTION OF THE PRIOR ART

Electrical contacts that are resistant to arcing and welding are well known to the art. U.S. Pat. No. 4,088,480, to Kim et al describes a method of preparing a cadmium-containing, refractory metal-silver alloy that is useful as an electrical contact in high electric current applications.

U.S. Pat. No. 3,327,883, to Neely, discloses an electrical contact formed of silver or copper together with a refractory metal and a dopent. The electrical contact disclosed in the Neely patent is resistant to arc erosion, welding or sticking when placed in service.

Doping electrical contacts with other materials such as bismuth is disclosed in the U.S. Pat. No. 3,686,456 to Talento. Electrical contacts that include a mixture of silver or copper with an alloy of tungsten carbide or titanium carbide are disclosed in the U.S. Pat. No. 4,137,076 to Hoyer et al. Again, such contacts provide weld resistance and low electrical resistance when current flows through the closed contacts even after repeated cyclings.

Impregnated sintered materials for making electrical contacts from a powdered mixture of copper together with a wetting promoting metal plus up to 5 Wt.% graphite is disclosed in the U.S. Pat. No. 4,153,755 to Rothkegel. Tungsten-silver or copper-magnesium oxide electrical contacts are disclosed in the U.S. Pat. No. 3,827,883 to Neely. In Neely's Patent, the magnesium oxide is used to provide the contact material with improved resistance to arc erosion and improved arc interruption characteristics.

U.S. Pat. No. 4,361,033 and No. 4,294,616 to Kim et al., disclose electrical contacts of the silver-cadmium oxide type. In these patents, the silver is the electrical conductor and cadmium oxide is added for its weld inhibiting characteristics.

We have found that it is extremely difficult to weld or braze the doped electrical contacts to electrically conductive supports. The very same material (graphite or cadmium oxide) that inhibits the arc weld on the working surface of the electrical contact also inhibits brazing or welding of it to the support.

Such problems have been recognized by the art and it has been conventional to dispose a cadmium oxide or graphite-free layer upon the electrical contact. One of the more conventional methods for providing this outer layer has been to make the electrical contact from discrete parts that can be pressed together into a single construction using a double fill press. Such methods are relatively complex and cumbersome and require a great deal of control to provide a high quality electrical contact. Another method commonly used with silver-graphite contacts has been to oxidize the contacts in air to burn the carbon from the outer surfaces of the electrical contact after it is formed. The faces and sides of the contact, however, can also be depleted of the graphite thus reducing the arc inhibiting properties that are imparted though the incorporation of the graphite. As is apparent, the control of the degraphitization process is difficult because of heating rates and the geometry of the electrical contact. Moreover, degraphitization can also oxidize some of the minor components of the electrical contact such as tungsten, tungsten carbide, nickel, or copper since these elements also oxidize in air and would have to be then reduced back to the metal before the device could be used.

The art has taught the use of an intermediate layer of aluminum to enable the consumer to weld the electrical contact to a support structure. For example, the U.S. Pat. No. 3,574,570 to Gwyn discloses an electrical contact of tungsten or molybdenum or molybdenum carbide or tungsten carbide that is to be welded or brazed to an aluminum support. The aluminum layer is disposed between the aluminum support and the electrical contact and 25 serves as a weldable interface for the two.

SUMMARY OF THE INVENTION

According to the present invention we have discovered new electrical contacts and a process for manufacturing them. The contacts are formed of an electrically conductive metal such as silver or copper and contain a minor amount of graphite or cadmium oxide. The electrical contacts of our invention can be easily attached to a conductive support while still maintaining the electrical characteristics plus the reduction in sticking and arc welding.

According to our invention, the electrical contacts are formed of a compressed and sintered conductive material, silver or copper, and include a minor amount of graphite or cadmium oxide. These electrical contacts have a working surface and an obverse side. A sintered coating of the electrically conductive metal, silver or copper, is disposed on the obverse side of the contact. The sintered coating is quite thin, generally in the order of 0.001" to 0.01". It is formed by spraying the obverse sides of the green (as pressed) contacts with a slurry of the conductive metal that is slurried in the alcohol and wax has a particle size between about 1 and 5 microns and is easily sprayed upon the compressed bodies that will form the electrical contact. A sufficient number of layers can be coated upon the contacts to provide an adequate interface between the conductive supports and the electrical contacts upon which they will be disposed. Following the coating of the green electrical contacts, they are dried in air by natural evaporation or in a vacuum drier. Then they are sintered at a temperature which is less than the melting point of the primary conductive metal whereby the electrical contacts and their respective coatings are firmly joined together.

Our invention has special applicability to electrical contacts manufactured of silver and graphite, or silver and nickel and graphite, or silver and tungsten carbide and graphite, or copper and graphite or silver and cadmium oxide. The graphite concentration is usually between about 0.5 and 5 Wt.% and the cadmium oxide is between about 5 and 25 Wt.%.

Following sintering, the contact is pressed again or coined and rolled. Repeated coatings of the green electrical contact can be readily made before sintering and the coining or pressing until a thickness is established which is adequate to form an effective interface between the electrical contact and the support structure. With the coatings according to our invention, we have found that after sintering, the silver or copper particles are formed into a porous network. The interface structure is relatively plastic at sintering temperatures and thus does not cause warpage of the electrical contact upon which it is disposed.

We have also found that when the electrical contact is welded or brazed to the support structure, a continuous interface is formed. Shear tests show that the interface is substantially as strong as the contact itself.

DESCRIPTION OF THE DRAWING

The FIGURE is a cross sectional, side elevational view of the electrical contact disposed upon an electrically conductive support.

DETAILED DESCRIPTION OF THE DRAWING

The contact 1 of the present invention is connected to a brass or copper support 2 by well known brazing or welding techniques. An intermediate layer 3 is formed of the conductive material that comprises contact 1 and is disposed between the support 2 and the contact 1. It is applied by the techniques herein disclosed.

The following examples are given to enable those skilled in the art to more clearly understand and practice the present invention. The examples should not be considered as limitative upon the scope of the invention, but as merely being illustrative and representative thereof.

SPECIFIC EXAMPLES

A silver powder slurry spray is prepared by mixing a 2.5 micron silver powder with a 50 Wt.% solution of Carbowax 3350 dissolved in a 70/30 volume ratio of 200 proof ethanol and water. A ratio of 3 to 1 solution to powder ratio was chosen to provide a good consistency when sprayed from equipment that was readily available in the laboratory. The mixture of powder and liquids was thoroughly mixed in a Waring blender for a few seconds to evenly disperse the powders. The spray slurry was then poured into receiving flask of a glass atomizer and used immediately. "Green" contacts of silver and graphite, or silver and nickel and graphite, or silver and cadmium oxide were sprayed with this slurry. A thicker coating, up to 0.010", can be formed by repeated sprayings without the coatings showing any signs of delamination or decohesion. One group of the sprayed contacts was dried in air and another group was dried in a vacuum. The contacts were then sintered in dissociated ammonia at below the melting temperature of the silver (for silver-graphite or silver-tungsten carbide-graphite contacts) and in air (for a silver-cadmium oxide contacts). In the sintering process, all of the Carbowax was burnt off and the silver particles sintered to each other (as well as to the contact) to form an integral part thereof. The sintered contacts were then further processed by coining or rolling, as usual, to produce the final product.

As another example, the same procedures were applied to a copper-graphite contact using a copper powder slurry in which the copper powder particles had a size of about 4 microns. The copper slurry was sprayed onto the green copper-graphite contact until a thickness of about 0.010 inch was reached an excellent brazing surface was formed on the contact.

It is apparent that modifications and changes can be made within the spirit and scope of the present invention but it is our intention, however, only to be limited be the scope of the appended claims.

As our invention we claim:

1. In the process for manufacturing contacts formed of an electrically conductive metal and containing a minor amount of graphite or cadmium oxide, said process comprising:

forming a mixture of finely divided electrically conductive metal and graphite or cadmium oxide; and compressing said mixture into a body having a working surface and an obverse side, said working surface being adapted to contact another electrically conductive surface and said obverse side being adapted to be secured to an electrically conductive support; and coating said obverse side of said body with a thin layer of said finely divided electrically conductive metal; and sintering the coated contact at a temperature less then the melting point of said electrically conductive metal, whereby said electrically conductive metal is firmly secured to said working surface.

2. The process according to claim 1 wherein the obverse side of said contact is welded to a support surface.

3. The process according to claim 1 wherein said electrically conductive metal is silver or copper.

4. The process according to claim 3 wherein said the mixture further contains nickel and/or tungsten carbide.

5. The process according to claim 1 wherein the electrically conductive metal that is coated upon the obverse side is sprayed upon the compressed body.

6. The process according to claim 5 wherein said electrically conductive metal is sprayed onto said body from a slurry of an evanescent carrier of alcohol and wax.

7. The process according to claim 6 wherein the electrically conductive metal has a particle size between about 1 and 5 microns.

8. The process according to claim 1 wherein the mixture contains between about 0.5 and 5% by weight graphite or 5 to 25% by weight cadmium oxide.

9. The process according to claim 8 wherein the coating is between about 0.0001 and 0.01 inch thick.

10. The process according to claim 1 further including the steps of coining or rolling the coated, compressed mixture after said body has been sintered.

11. The process according to claim 1 wherein sintering is conducted in a reducing atmosphere in the case of graphite doped contacts or an oxidizing atmosphere in the case of a cadmium oxide-doped contacts.

12. An electrically conductive contact formed of a conductive metal and including minor amount of graphite or cadmium oxide, said contact having a working surface and an obverse side; a sintered coating of a metal consisting essentially of said conductive metal disposed on said obverse side.

13. The contact according to claim 12 wherein said coating is between about 0.001 to 0.01 inch thick.

14. The contact according to claim 12 wherein the sintered coating is a porous network of sintered metal particles.

15. The contact according to claim 12 wherein said mixture further contains nickel and/or tungsten carbide.

16. The contact according to claim 12 wherein the contact contains between about 0.5 and 5.0% by weight graphite or 4 and 25% by weight cadmium oxide.

* * * * *